US011110705B2

(12) United States Patent
Nagamochi et al.

(10) Patent No.: US 11,110,705 B2
(45) Date of Patent: Sep. 7, 2021

(54) LIQUID-DISCHARGING-HEAD SUBSTRATE, LIQUID DISCHARGING HEAD, LIQUID DISCHARGING APPARATUS, METHOD OF MANUFACTURING LIQUID-DISCHARGING-HEAD SUBSTRATE

(71) Applicant: CANON KABUSHIKI KAISHA, Tokyo (JP)

(72) Inventors: Soichiro Nagamochi, Oita (JP); Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 16/196,962

(22) Filed: Nov. 20, 2018

(65) Prior Publication Data

US 2019/0084302 A1 Mar. 21, 2019

Related U.S. Application Data

(62) Division of application No. 15/425,423, filed on Feb. 6, 2017, now Pat. No. 10,166,772.

(30) Foreign Application Priority Data

Feb. 8, 2016 (JP) ..... 2016-022181

(51) Int. Cl.
*B41J 2/16* (2006.01)
*B41J 2/14* (2006.01)

(52) U.S. Cl.
CPC ..... *B41J 2/1412* (2013.01); *B41J 2/14072* (2013.01); *B41J 2/14088* (2013.01); *B41J 2/14129* (2013.01); *B41J 2/1601* (2013.01); *B41J 2/1603* (2013.01); *B41J 2/1626* (2013.01); *B41J 2/1631* (2013.01); *B41J 2/1642* (2013.01); *B41J 2/1646* (2013.01)

(58) Field of Classification Search
CPC ..... B41J 2/1601; B41J 2/1646; B41J 2/1626; B41J 2/1631; B41J 2/1642; B41J 2/1412; B41J 2/14088; B41J 2/14072; Y10T 29/49401; Y10T 29/494; Y10T 29/49082; Y10T 29/49083; Y10T 29/49087; Y10T 29/49155; Y10T 29/49158; Y10T 29/49124
USPC ..... 29/90.1, 890.09, 611, 613, 610.1, 619, 29/825, 829
See application file for complete search history.

(56) References Cited

U.S. PATENT DOCUMENTS

2002/0021336 A1* 2/2002 Moon ..... B41J 2/1603 347/65

* cited by examiner

*Primary Examiner* — Peter Dungba Vo
*Assistant Examiner* — Kaying Kue
(74) *Attorney, Agent, or Firm* — Canon U.S.A., Inc. I.P. Division

(57) ABSTRACT

A liquid-discharging-head substrate includes an insulation layer, an electrode, and a heating resistor element, wherein the insulation layer includes a first opening portion including a first opening formed in a surface of the insulation layer, a second opening having a smaller opening area than an opening area of the first opening, and a surface connecting the first opening and the second opening, and a second opening portion extending from the second opening to a back surface of the insulation layer, wherein the electrode is formed in the second opening portion, and a surface of the electrode is exposed from the second opening when viewed from the surface side of the insulation layer, and wherein the heating resistor element is in contact with the surface connecting the first opening and the second opening, and with the surface of the electrode.

8 Claims, 3 Drawing Sheets

LIQUID-DISCHARGING-HEAD SUBSTRATE, LIQUID DISCHARGING HEAD, LIQUID DISCHARGING APPARATUS, METHOD OF MANUFACTURING LIQUID-DISCHARGING-HEAD SUBSTRATE

CROSS REFERENCE TO RELATED APPLICATIONS

The present application is a divisional of U.S. patent application Ser. No. 15/425,423, filed on Feb. 6, 2017, which claims priority from Japanese Patent Application No. 2016-022181, filed Feb. 8, 2016, which is hereby incorporated by reference herein in its entirety.

BACKGROUND OF THE INVENTION

Field of the Invention

Aspects of the present invention relate to a liquid-discharging-head substrate for use in a liquid discharging head configured to discharge liquid, a liquid discharging head including the liquid-discharging-head substrate, a liquid discharging apparatus including the liquid discharging head, and a method of manufacturing the liquid-discharging-head substrate.

Description of the Related Art

A liquid-discharging-head substrate for use in a liquid discharging head includes heating resistor elements for discharging liquid. In recent years, there has been a demand for densely arranging the heating resistor elements in order to downsize the substrate. Further, there also has been a demand for a liquid discharging head with high durability and low power consumption.

Japanese Patent Application Laid-Open No. 11-10882 discusses a liquid-discharging-head substrate in which a first electrode wiring layer, an intermediate insulation layer, and a heating resistor element layer are provided in this order. The heating resistor element layer is electrically connected to the first electrode wiring layer via a through-hole section formed in the intermediate insulation layer. Further, the heating resistor element layer is electrically connected to a second electrode wiring layer formed beneath the heating resistor element layer. In this way, the first and second electrode wiring layers are arranged in a three-dimensional folded structure in a stacking direction beneath the heating resistor element layer in the substrate. This makes it possible to narrow intervals between adjacent heating resistor elements and thus densely arrange the heating resistor elements.

Further, in the structure discussed in Japanese Patent Application Laid-Open No. 11-10882, a surface including the intermediate insulation layer, the through-hole section, and the second electrode wiring layer is flattened using a chemical-mechanical polishing (CMP) method, and the heating resistor element layer is formed on the flattened surface. Meanwhile, in a case of a structure in which a thick layer such as an electrode wiring layer is formed on a heating resistor element layer, which is a different structure from the above structure, if a coating layer with which the electrode wiring layer is coated is thinly formed, a pinhole or crack may be formed in a large step height of the coating layer created by the electrode wiring layer. On the other hand, in the structure discussed in Japanese Patent Application Laid-Open No. 11-10882, no step height is created by the electrode wiring layer, and the layer coating the heating resistor element layer is formed on the flattened surface, so even when the coating layer is thinly formed, the heating resistor element layer is coated properly. Thus, thermal energy can be applied efficiently to liquid to reduce the power consumption of the liquid discharging head.

SUMMARY OF THE INVENTION

According to an aspect of the present invention, a liquid-discharging-head substrate includes an insulation layer, an electrode, and a heating resistor element, wherein the insulation layer includes a first opening portion including a first opening formed in a surface of the insulation layer, a second opening having a smaller opening area than an opening area of the first opening, and a surface connecting the first opening and the second opening, and a second opening portion extending from the second opening to a back surface of the insulation layer, wherein the electrode is formed in the second opening portion, and a surface of the electrode is exposed from the second opening when viewed from the surface side of the insulation layer, and wherein the heating resistor element is in contact with the surface connecting the first opening and the second opening and, with the surface of the electrode.

Further features of the present invention will become apparent from the following description of exemplary embodiments with reference to the attached drawings.

DESCRIPTION OF THE EMBODIMENTS

When surfaces of an intermediate insulation layer (hereinafter, sometimes referred to as "insulation layer") and an electrode embedded in a through hole portion (hereinafter, sometimes referred to as "opening portion") is flattened using a chemical-mechanical polishing (CMP) method, a portion of the electrode is removed from the opening portion due to chemical action of a slurry and compression action of a polishing pad. Consequently, a step height is formed between the surfaces of the insulation layer and the electrode to expose a corner portion of the insulation layer in the opening portion. Such a recessed portion thus formed by the surfaces of the insulation layer and the electrode in the opening portion is referred to as a recess.

When a heating resistor element layer is formed on the surface of the insulation layer having such a corner portion, since it is difficult to form the heating resistor element layer on the corner portion, the heating resistor element layer formed on the corner portion is thinner than the heating resistor element layer formed on the flattened surface. When a head is driven, a high voltage is applied to the thin portion of the heating resistor element layer, which may promote oxidation of the heating resistor element to decrease the durability of the head.

However, if the heating resistor element layer is thickly formed to improve step coverage in order to overcome the above problem, the resistance value of the heating resistor elements decreases, and the power needed to drive the head increases.

An embodiment of the present invention is directed to a liquid-discharging-head substrate that has high durability and can avoid the increase of power needed for driving.

Various exemplary embodiments of the invention will be described below with reference to the drawings. The exemplary embodiments described below are mere examples of implementation of the invention and are not intended to limit the scope of the invention.

<Liquid Discharging Apparatus>

Figure 3A:
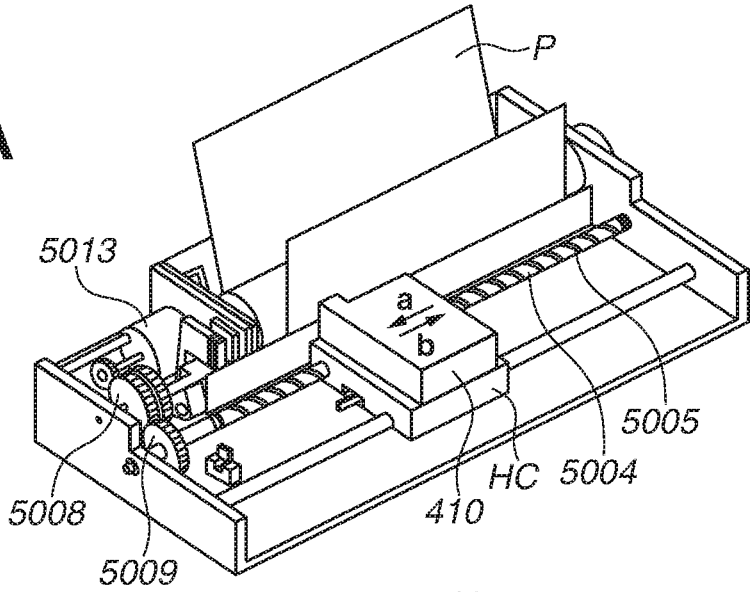
FIGS. 3A, 3B, and 3C are schematic perspective views respectively illustrating examples of a liquid discharging apparatus, a liquid discharging head unit, and a liquid discharging head.

FIG. 3A is a schematic perspective view illustrating a liquid discharging apparatus to which a liquid discharging head according to the present exemplary embodiment can be attached. As illustrated in FIG. 3A, a lead screw 5004 is rotated along with forward and backward rotations of a driving motor 5013 via driving force transmission gears 5008 and 5009. A liquid discharging head unit 410 can be placed on a carriage HC. The carriage HC includes a pin (not illustrated) configured to be engaged with a helical groove 5005 of the lead screw 5004, and when the lead screw 5004 is rotated, the carriage HC is reciprocated in the directions of arrows a and b.

<Liquid Discharging Head and Liquid Discharging Head Unit>

Figure 3B:
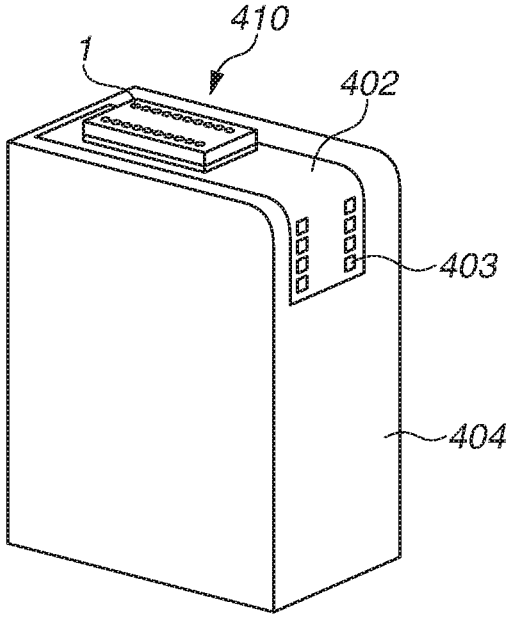

FIG. 3B is a perspective view illustrating an example of the liquid discharging head unit 410 including a liquid discharging head according to the present exemplary embodiment. The liquid discharging head unit 410 includes a liquid discharging head 1 and a liquid storage portion 404 configured to store liquid to be supplied to the liquid discharging head 1, and the liquid discharging head 1 and the liquid storage portion 404 are integrated to form a cartridge. The liquid discharging head 1 is provided in a surface facing a recording medium P illustrated in FIG. 3A. The liquid discharging head 1 and the liquid storage portion 404 do not have to be integrated, and the liquid storage portion 404 may be configured to be removable. Further, the liquid discharging head unit 410 includes a tape member 402. The tape member 402 includes a terminal for supplying power to the liquid discharging head 1 and transmits and receives power and various types of signals to and from a main body of the liquid discharging apparatus via contact points 403.

Figure 3C:
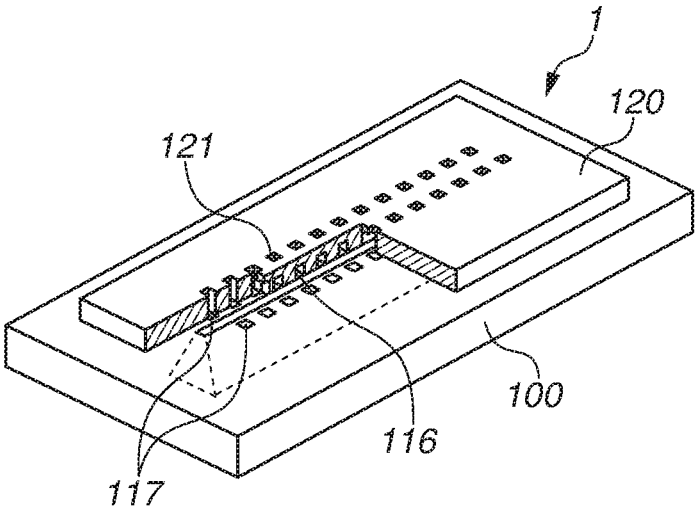

FIG. 3C is a schematic perspective view illustrating the liquid discharging head 1 according to the present exemplary embodiment. The liquid discharging head 1 includes a liquid-discharging-head substrate 100 and a channel forming member 120. The liquid-discharging-head substrate 100 includes arrays of heat application units 117 for applying thermal energy generated by a heating resistor element to liquid. Further, the channel forming member 120 includes arrays of discharge ports 121 for discharging the liquid corresponding to the heat application units 117. Power and signals are transmitted from the liquid discharging apparatus to the liquid-discharging-head substrate 100 via the tape member 402. Thermal energy generated by the heating resistor element being driven is applied to the liquid via the heat application units 117, and the liquid produces bubbles and is discharged from the discharge ports 121.

[Liquid-Discharging-Head Substrate]

Figure 1A:
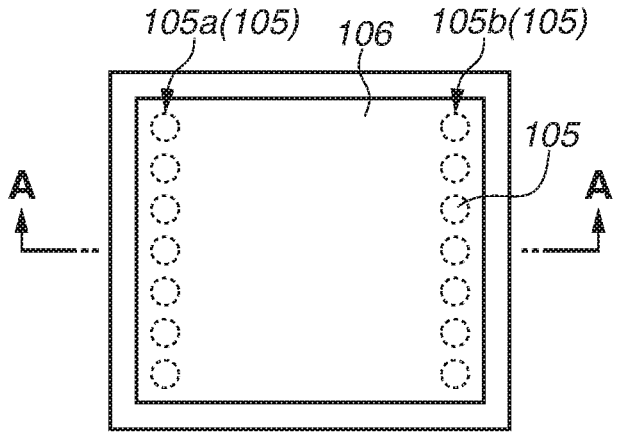
FIG. 1A is a top view illustrating a portion including a heating resistor element of a liquid-discharging-head substrate.

FIG. 1A is a top view illustrating a portion including a heating resistor element 106 of the liquid-discharging-head substrate 100 according to the present exemplary embodiment. A plurality of electrodes 105 (105*a*, 105*b*) is provided in respective end portions of the heating resistor element 106 provided in the liquid-discharging-head substrate 100. The electrodes 105*a* and 105*b* are provided in pairs, and electricity passes through the electrodes 105*a* and 105*b* to the heating resistor element 106, whereby the heating resistor element 106 between the electrodes 105*a* and 105*b* generates heat.

FIGS. 1B to 1I are schematic cross sectional views illustrating the liquid-discharging-head substrate 100 along line A-A specified in FIG. 1A and illustrate the steps of manufacturing the liquid-discharging-head substrate 100. The following describes a method of manufacturing the liquid-discharging-head substrate 100.

Figure 1B:
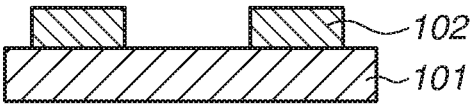
FIGS. 1B to 1I are cross sectional views illustrating the steps of manufacturing the portion.

First, as illustrated in FIG. 1B, a layer of metal such as aluminum, tungsten, copper, silver, gold, platinum, or an alloy containing at least one of aluminum, tungsten, copper, silver, gold, and platinum is formed on a surface of a base 101 such as a silicon base by a chemical vapor deposition (CVD) method, sputtering method, etc. The layer of metal is patterned using a known method such as photolithography to form wiring 102. The base 101 may include a switching element such as a transistor and wiring and may further include an insulation layer to coat the switching element and the wiring.

Figure 1C:
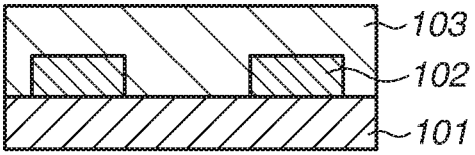
Figure 1D:
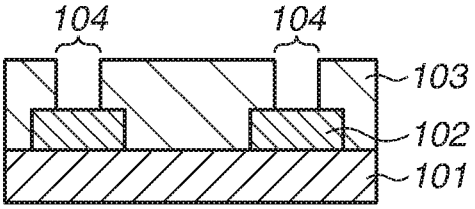

Next, as illustrated in FIG. 1C, an insulation layer 103 containing, for example, SiO or SiN is formed using a CVD method, sputtering method, etc. to coat the wiring 102. Next, as illustrated in FIG. 1D, opening portions 104 are formed in the insulation layer 103 using a method such as photolithography to expose a surface of the wiring 102 from the opening portions 104. In the foregoing steps illustrated in FIGS. 1B to 1D, a substrate provided with the insulation layer 103 including the opening portions 104 is prepared.

Figure 1E:
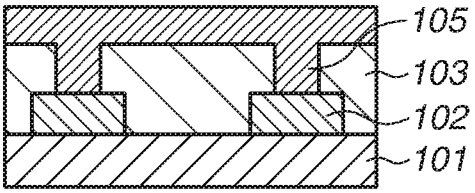

Next, as illustrated in FIG. 1E, a metal film 105 as an electrode material is formed inside the opening portions 104 and on the surface of the insulation layer 103 using a CVD method, sputtering method, etc. Examples of an electrode material that can be used include aluminum, tungsten, copper, silver, gold, platinum, and an alloy containing at least one of aluminum, tungsten, copper, silver, gold, and platinum.

Figure 1F:
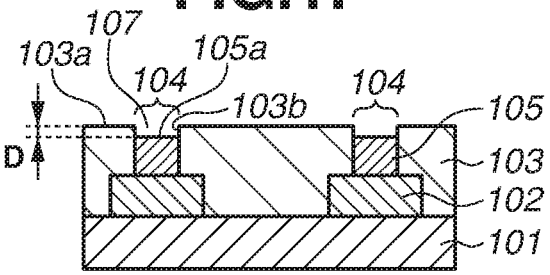

Next, as illustrated in FIG. 1F, the metal film 105 is removed from the surface of the insulation layer 103 using a CMP method to expose the surface 103*a* of the insulation layer 103, and the surface 103*a* is flattened. In this way, electrodes 105 are formed from the metal film 105 inside the opening portions 104.

At this time, owing to chemical action of a slurry and compression action of a polishing pad that are used in the CMP method, a portion of the electrodes 105 is removed from the opening portions 104. Consequently, step heights are formed between the surface 103*a* of the insulation layer 103 and surfaces 105*a* of the electrodes 105, and corner portions 103*b* formed by the surface 103*a* of the insulation layer 103 and the opening portions 104 are exposed. Further, recessed portions 107 referred to as recesses are formed by the opening portions 104 and the surfaces 105*a* of the electrodes 105. The recessed portions 107 are formed with a depth D (FIG. 1F) of about 5 nm to 40 nm, depending on conditions of the CMP method. The depth D of a recessed portion 107 refers to a distance between the surface 103*a* of the insulation layer 103 and the surface 105*a* of the electrode 105 in a direction orthogonal to the surface 103*a* of the insulation layer 103.

Figure 1G:
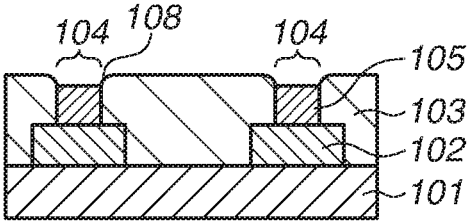

Next, as illustrated in FIG. 1G, the corner portions 103*b* of the insulation layer 103 are selectively etched and removed by reverse sputtering. In this way, the portions where the corner portions 103*b* were formed form a smooth surface 108. The reverse sputtering is specifically a process of applying electric potential to the base 101 to cause ions in plasma to collide with the base 101 side.

Figure 1H:
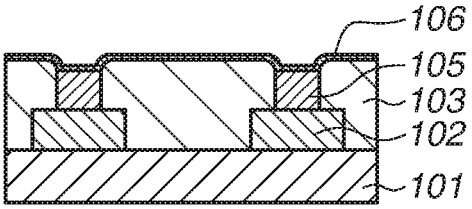

Next, as illustrated in FIG. 1H, a heating resistor element layer 106 is formed so as to contact the surface 103*a* of the insulation layer 103 and the surfaces 105*a* of the electrodes 105. The heating resistor element layer 106 is formed using, for example, an alloy such as NiCr, a metal boride such as $ZrB_2$, or a metal nitride such as TaN or TaSiN by a vacuum deposition method, sputtering method, etc. with a thickness of 5 nm to 100 nm.

In the step of removing the corner portions 103*b*, after the removal of the corner portions 103*b*, it is desirable to form the heating resistor element layer 106 within an apparatus which conducts the reverse sputtering, without removing the base 101 from the apparatus. This is because the heating resistor element layer 106 thus formed has better layer quality since the heating resistor element layer 106 can be formed while the surface 103*a* of the insulation layer 103 and the surface 108 having been cleaned by the reverse sputtering are kept in the cleaned state. Another reason for forming the heating resistor element layer 106 is that since an oxide film formed on the surfaces 105*a* of the electrodes 105 is removed, electrical contact failure between the electrodes 105 and the heating resistor element layer 106 can be prevented.

Figure 1I:
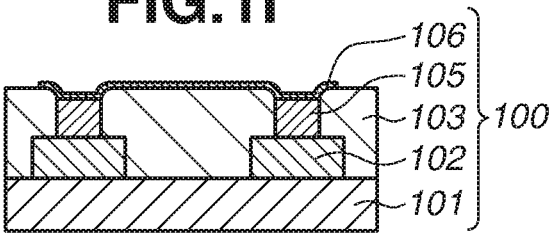

Next, as illustrated in FIG. 1I, the heating resistor element layer 106 is patterned to form heating resistor elements 106.

To protect the heating resistor elements 106, an insulation layer containing, for example, SiO or SiN or an anti-cavitation layer containing, for example, a film of a metal such as Ta, Au, Pt, Ir, or stainless steel (SUS) may be formed to coat the heating resistor elements 106.

In the present exemplary embodiment, as described above, the corner portions 103*b* of the insulation layer 103 are removed and the surface 108 is formed on the portions from which the corner portions 103*b* are removed as illustrated in FIG. 1G. Thus, even when the heating resistor element layer 106 is thinly formed on the surface 108, good step coverage is realized, whereby a liquid-discharging-head substrate with excellent durability can be formed.

Figure 2A:
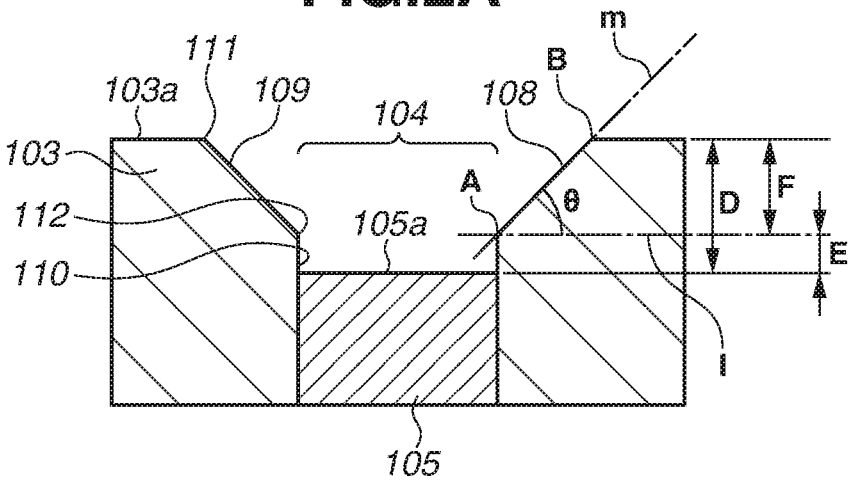
FIGS. 2A, 2B, and 2C are cross sectional views each illustrating a neighborhood of an electrode on which a heating resistor element layer of a liquid-discharging-head substrate is to be formed.
Figure 2B:
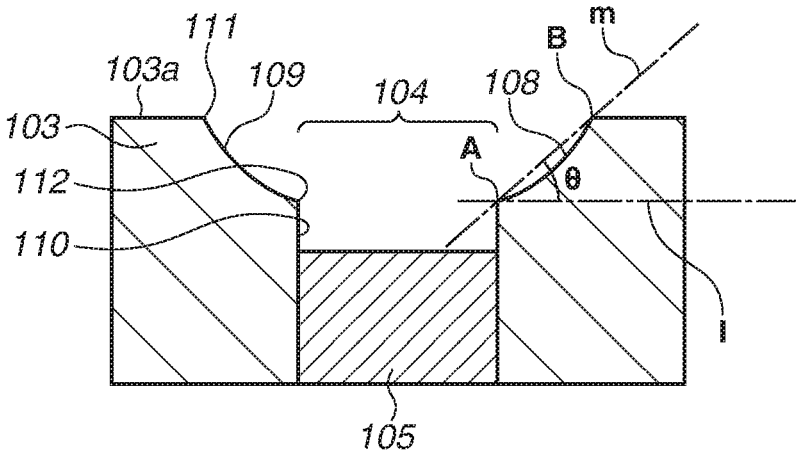
Figure 2C:
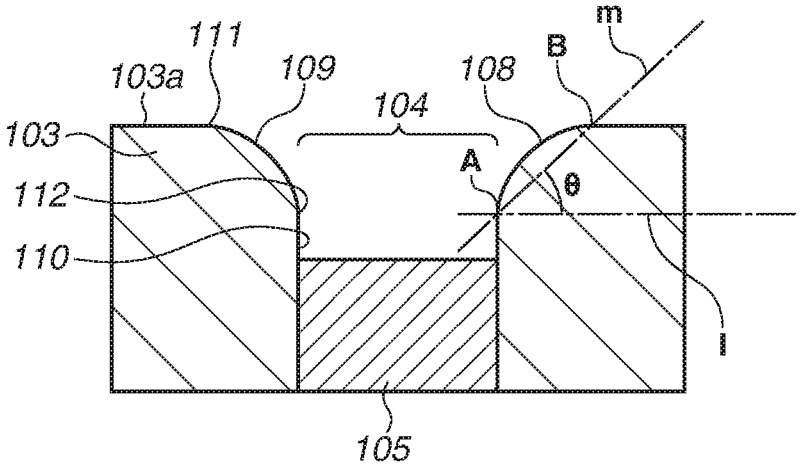

FIGS. 2A to 2C are cross sectional views each illustrating a neighborhood of the electrode 105 of the liquid-discharging-head substrate 100 in a state after the corner portions 103*b* are removed and before the heating resistor element layer 106 is formed. The following describes the structure of the opening portion 104 of the insulation layer 103 from which the corner portions 103*b* are removed, with reference to FIG. 2A. The opening portion 104 includes a first opening portion 109 and a second opening portion 110. The first opening portion 109 is located on the surface 103*a* side of the insulation layer 103. The second opening portion 110 is where the electrode 105 is provided. The first opening portion 109 is a portion formed through a process of removing the corner portions 103*b* of the insulation layer 103 in FIG. 1G, and the second opening portion 110 is a portion of the opening portion 104 formed through a process illustrated in FIG. 1D. Further, the first opening portion 109 includes a first opening 111, a second opening 112, and the surface 108 connecting the first opening 111 and the second opening 112. The first opening 111 is formed in the surface 103*a* of the insulation layer 103. The second opening 112 has a smaller opening area than the opening area of the first opening 111. Specifically, the second opening 112 is the lowermost portion of the surface 108. Further, the second opening portion 110 extends from the second opening 112 to a back surface of the insulation layer 103.

FIGS. 2A to 2C each illustrate an example of the shape of the surface 108 of the insulation layer 103. The surface 108 may be an inclined surface (FIG. 2A) inclined with respect to the surface 103*a* of the insulation layer 103, a curved surface (FIG. 2B) depressed inward, or a curved surface (FIG. 2C) protruding outward. The curved surface illustrated in FIG. 2C is preferable to the curved surface illustrated in FIG. 2B because the heating resistor element layer 106 can be formed more easily on a surface of the curved surface illustrated in FIG. 2C.

At the time of removing the corner portions 103*b*, a step between the surface 105*a* of the electrode 105 and the surface 108 of the insulation layer 103, i.e., a distance E (FIG. 2A) between the surface 105*a* of the electrode 105 and the second opening 112 in a direction orthogonal to the surface 103*a* of the insulation layer 103, is desirably set as follows. Specifically, the distance E is desirably set less than the thickness (the length in the orthogonal direction) of the heating resistor element layer 106 formed on the surface 105*a* of the electrode 105. In this way, favorable coverage of the step between the surface 105*a* of the electrode 105 and the surface 108 of the insulation layer 103 can be realized.

Further, in order to realize the favorable step coverage even when the heating resistor element layer 106 is thinly formed, the distance E is desirably 25 nm or smaller, more desirably 10 nm or smaller. The distance E is even more desirably 0, i.e., the surface 105*a* of the electrode 105 and the second opening 112 are desirably on the same surface. Further, the inclination angle of the surface 108 is desirably 70° or smaller. Further, the inclination angle of the surface 108 is desirably 5° or larger.

The inclination angle of the surface 108 is defined as follows. For example, in the cross section illustrated in FIG. 2A, a point B (point through which the first opening 111 passes) is a boundary portion between the surface 108 and the flat surface 103*a* of the insulation layer 103. An angle θ formed on the insulation layer 103 side by a straight line l, which passes through a point A (point through which the second opening 112 passes) and is parallel to the surface 103*a* of the insulation layer 103, and a straight line m, which passes through the points A and B, is the inclination angle of the surface 108. The inclination angle of the surface 108 is similarly defined even in a case of a shape which is different from the shape described above, such as a case where the surface 108 is in the shape of a curved surface (FIG. 2B, 2C).

The liquid-discharging-head substrates 100 of Examples 1-1 to 1-4 were prepared as follows.

First, the wiring 102 with a thickness of 200 nm was formed on the base 101 using Al by a sputtering method and photolithography (FIG. 1B). Next, a SiO layer with a thickness of 1 μm was formed to form the insulation layer 103 (FIG. 1C), and the opening portions 104 were formed in the insulation layer 103 by patterning using photolithography to expose the surface of the wiring 102 (FIG. 1D). Next, a tungsten layer 105 was formed on the surface of the insulation layer 103 using a CVD method so as to fill the opening portions 104 (FIG. 1E).

Next, the tungsten layer 105 was removed using a CMP method so as to expose the surface 103*a* of the insulation layer 103, and the surface 103*a* of the insulation layer 103 was flattened. In this way, the electrodes 105 were formed from the tungsten layer 105. At this time, a portion of the tungsten layer 105 in the neighborhood of the surface 103*a* of the insulation layer 103 was also removed, and the surfaces 105*a* of the electrodes 105 were formed inward from the surface 103*a* of the insulation layer 103. Thus, the recessed portions 107 were formed by the opening portions 104 and the surfaces 105*a* of the electrodes 105 to expose the corner portions 103*b* of the insulation layer 103 (FIG. 1F). The recessed portions 107 had a depth D (FIG. 2A) of 30 nm.

Next, reverse sputtering was conducted by applying a radio frequency (RF) electric field to the base 101 in an Ar gas atmosphere to selectively etch and remove the corner portions 103*b* of the insulation layer 103. In this way, the corner portions 103*b* of the insulation layer 103 were formed into the smooth surface 108 (FIG. 1G). In the present exemplary embodiment, a pressure condition in the reverse sputtering was changed for each of Examples 1-1 to 1-4 as specified in Table 1 to change the inclination angle of the surface 108. In each of Examples 1-1 to 1-4, the reverse sputtering processing time was adjusted such that a cut length F (FIG. 2A) by the reverse sputtering in the depth direction (the direction orthogonal to the surface 103*a*) of the insulation layer 103 was 20 nm. The cut length F is also the length of the first opening portion 109 in the direction orthogonal to the surface 103*a* of the insulation layer 103.

Next, the heating resistor element layer 106 containing TaSiN was formed on the surfaces of the insulation layer 103 and the electrodes 105 using a sputtering method (FIG. 1H). At this time, the heating resistor element layer 106 on the flattened surface 103*a* of the insulation layer 103 was formed so as to have a thickness of 20 nm.

Thereafter, a SiN layer was formed as an insulation layer with a thickness of about 150 nm, using a plasma CVD method (FIG. 1I).

The liquid-discharging-head substrates 100 of Examples 1-1 to 1-4 were observed with a transmission electron microscope to measure a minimum layer thickness of the heating resistor element layer 106 formed on the surface of the surface 108 of the insulation layer 103. In the case where the surface 108 is an inclined surface, the layer thickness is the length of the heating resistor element layer 106 in the direction orthogonal to the surface 108. In the case where the surface 108 is a curved surface, the layer thickness is the length of the heating resistor element layer 106 in the direction orthogonal to the tangent line of the surface 108. Further, a liquid-discharging-head substrate of a comparative example, in which the step illustrated in FIG. 1G was not conducted and the corner portions 103*b* of the insulation layer 103 remained, was also observed to measure the minimum layer thickness of the heating resistor element layer 106 formed on the corner portions 103*b*.

Further, the liquid-discharging-head substrates 100 of Examples 1-1 to 1-4 and the liquid-discharging-head substrate of the comparative example were driven under the following conditions to evaluate thermal stress durability.

Driving frequency: 10 KHz.

Driving pulse width: 2 μsec.

Driving voltage: 1.3 times the voltage at which liquid produces bubbles.

The thermal stress durability of the heating resistor element 106 was evaluated using the following criteria.

A: No fracture occurred even at $6.0\times10^9$ pulses or more.

B: A fracture occurred at $4.0\times10^9$ pulses or more and less than $6.0\times10^9$ pulses.

C: A fracture occurred at $2.0\times10^9$ pulses or more and less than $4.0\times10^9$ pulses.

D: A fracture occurred at less than $2.0\times10^9$ pulses.

The layer thicknesses of the heating resistor elements 106 and results of the thermal stress durability evaluation are shown in Table 1.

TABLE 1

| | Pressure (Torr) | Inclination Angle (°) | Cut Length F in Depth Direction (nm) | Thickness of Heating Resistor Element on Surface 108 or Corner Portion (nm) | Result of Durability Evaluation |
|---|---|---|---|---|---|
| Comparative Example | — | 90 | — | 10 | D |
| Example 1-1 | 1 | 70 | 20 | 13 | C |
| Example 1-2 | 0.08 | 45 | 20 | 16 | B |
| Example 1-3 | 0.01 | 10 | 20 | 13 | C |
| Example 1-4 | 0.005 | 5 | 20 | 12 | C |

From the results of the thermal stress durability evaluation, it is found that the liquid-discharging-head substrates 100 of Examples 1-1 to 1-4, in which the corner portions 103*b* were removed to form the surface 108, are durable enough to withstand thermal stress. The layer thickness of the heating resistor element 106 on the surface 108 and the corner portions 103*b* was smaller than the layer thickness of the heating resistor element 106 on the flattened surface 103*a* of the insulation layer 103. However, in Examples 1-1 to 1-4, since the corner portions 103*b* were removed to form the surface 108, the heating resistor element 106 was formed such that a thin portion of the heating resistor element 106 also had a sufficient thickness. Accordingly, it is considered that Examples 1-1 to 1-4 exhibits high durability because oxidation of the heating resistor element 106 caused by application of a large voltage to the thin portion of the heating resistor element 106 is prevented when driving the head. It is found that the inclination angle of the surface 108 is desirably 70° or smaller. Further, it is found that the inclination angle of the surface 108 is desirably 0° or larger but more desirably 5° or larger.

The liquid-discharging-head substrates 100 of Examples 2-1 to 2-3 were prepared. In Examples 2-1 to 2-3, as specified in Table 2, the pressure condition in the reverse sputtering was set constant to set the inclination angle θ of the surface 108 constant, and the reverse sputtering processing time was adjusted such that the cut length F (FIG. 2A) of the insulation layer 103 in the depth direction was varied. Conditions other than the conditions specified in Table 2 were the same as those in Examples 1-1 to 1-4.

Further, as in Examples 1-1 to 1-4, the layer thickness of the heating resistor element layer 106 formed on the surface 108 of the insulation layer 103 was measured, and the thermal stress durability was evaluated. The results are shown in Table 2.

TABLE 2

| | Pressure (Torr) | Inclination Angle (°) | Cut Length F in Depth Direction (nm) | Distance E (nm) | Thickness of Heating Resistor Element on Surface 108 (nm) | Result of Durability Evalution |
|---|---|---|---|---|---|---|
| Example 2-1 | 0.08 | 45 | 5 | 25 | 13 | C |
| Example 2-2 | 0.08 | 45 | 20 | 10 | 16 | B |
| Example 2-3 | 0.08 | 45 | 30 | 0 | 18 | A |

From the results of the thermal stress durability evaluation, it is found that the liquid-discharging-head substrates 100 of Examples 2-1 to 2-3, in which the corner portions 103*b* were removed to form the surface 108, are durable enough to withstand thermal stress. Further, it is found that the closer the cut length F is to the value (30 nm in the present Example) of the depth D of the recessed portion 107 (FIG. 2A), the higher the durability becomes. The difference between the cut length F and the depth D of the recessed portion 107 is the distance E (FIG. 2A) between the surface 105*a* of the electrode 105 and the second opening 112 in the direction orthogonal to the surface 103*a* of the insulation layer 103. Specifically, the distance E is a step between the surface 105*a* of the electrode 105 and the surface 108 of the insulation layer 103, and it is considered that the coverage of the heating resistor element layer 106 formed on the surface 108 improved because the step was reduced. From the results shown in Table 2, it is found that the distance E (FIG. 2A) is desirably 25 nm or smaller, more desirably 10 nm or smaller. Further, it is found that the distance E is more desirably zero, i.e., it is further desirable that the surface 105*a* of the electrode 105 and the second opening 112 are on the same surface.

Further, as described above, in Examples 2-1 to 2-3, the heating resistor element layer 106 was formed such that the layer thickness of the heating resistor element layer 106 formed on the flattened surface 103*a* of the insulation layer 103 was 20 nm. It is found that in order to realize good step coverage between the surface 105*a* of the electrode 105 and the surface 108 of the insulation layer 103, the distance E is more desirably smaller than the thickness (i.e., the length of the heating resistor element 106 in the orthogonal direction) of the heating resistor element layer 106 to be formed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A method of manufacturing a liquid-discharging-head substrate, the method comprising:

preparing a substrate with an insulation layer including an opening portion;

filling the opening portion with an electrode material;

forming an electrode from the electrode material by flattening the electrode material using a chemical-mechanical polishing method to position a surface of the electrode inward from a surface including an opening of the opening portion of the insulation layer and to form the electrode embedded in the opening portion;

removing a corner portion exposed by forming of the electrode, which includes the surface of the insulation layer and a wall of the opening portion, by conducting reverse sputtering to the surface of the insulation layer; and forming a heating resistor element contacting the surface of the insulation layer and the surface of the electrode after the reverse sputtering.

2. The method according to claim 1, wherein the heating resistor element is formed by sputtering within an apparatus which is configured to conduct the reverse sputtering.

3. The method according to claim 1, wherein in the removing of the corner portion, a surface connecting a first opening formed in the surface of the insulation layer and a second opening having a smaller opening area than an opening area of the first opening is formed on the wall of the opening portion.

4. The method according to claim 3, wherein in the forming of the heating resistor element, a length of the heating resistor element contacting the surface of the electrode in a direction orthogonal to the surface of the insulation layer is set larger than a distance between the second opening and the surface of the electrode in the orthogonal direction.

5. The method according to claim 1, wherein in the forming of the heating resistor element, a length of the heating resistor element contacting the surface of the insulation layer in a direction orthogonal to the surface of the insulation layer is set to 5 nm to 100 nm.

6. The method according to claim 1, wherein in the forming of the electrode, at least one pair of electrodes is formed, and wherein in the forming of the heating resistor element, the heating resistor element contacts the surface of the at least one pair of electrodes and a portion of the heating resistor element located between the at least one pair of electrodes generates heat.

7. The method according to claim 1, wherein the reverse sputtering is conducted by applying electric potential to the substrate in an Ar gas atmosphere.

8. The method according to claim 1, wherein in the forming of the heating resistor element, a length of the heating resistor element contacting the surface of the electrode in a direction orthogonal to the surface of the insulation layer is set larger than a distance between the surface of the insulation layer and the surface of the electrode in the orthogonal direction.

* * * * *